US006196668B1

(12) United States Patent
Bode

(10) Patent No.: US 6,196,668 B1
(45) Date of Patent: Mar. 6, 2001

(54) INK JET PRINT HEAD MODULES WITH COMMON INK SUPPLY

(75) Inventor: Henry J. Bode, Oak Park, IL (US)

(73) Assignee: Marconi Data Systems, Wood Dale, IL (US)

( * ) Notice: Subject to any disclaimer, the term of this patent is extended or adjusted under 35 U.S.C. 154(b) by 0 days.

(21) Appl. No.: 08/854,487

(22) Filed: May 12, 1997

(51) Int. Cl.[7] ..... B41J 2/175
(52) U.S. Cl. ..... 347/85
(58) Field of Search ..... 347/85, 86, 87, 347/89

(56) References Cited

U.S. PATENT DOCUMENTS

| | | | | |
|---|---|---|---|---|
| 4,282,536 | * | 8/1981 | Paschen et al. | 346/140.1 |
| 4,329,696 | | 5/1982 | Denlinger et al. | 347/6 |
| 4,340,896 | | 7/1982 | Cruze-Uribe et al. | 347/85 |
| 4,413,267 | | 11/1983 | Hein | 347/89 |
| 4,677,448 | * | 6/1987 | Mizusawa et al. | 347/85 |
| 4,677,845 | | 7/1987 | Izumi et al. | 736/54.11 |
| 4,680,595 | | 7/1987 | Cruz-Uribe et al. | 347/40 |
| 4,694,307 | | 9/1987 | Toganoh et al. | 347/85 |
| 4,825,228 | | 4/1989 | Gloeckler et al. | 347/7 |
| 4,915,718 | | 4/1990 | Desai | 65/31 |
| 5,485,187 | | 1/1996 | Okamura et al. | 347/85 |
| 5,592,203 | | 1/1997 | Thiel et al. | 347/40 |
| 5,818,484 | * | 10/1998 | Lee et al. | 347/86 |

FOREIGN PATENT DOCUMENTS

| | | | | |
|---|---|---|---|---|
| 327925 | * | 4/1930 | (GB) . | |
| 55-142668 | | 4/1979 | (JP) | B41J/3/04 |
| 58-057969 | | 4/1983 | (JP) | B41J/3/04 |
| 59-222361 | | 5/1983 | (JP) | B41J/3/04 |
| 60 048360 | | 8/1983 | (JP) | B41J/3/04 |
| 01 297259 | | 5/1988 | (JP) | B41J/3/04 |

* cited by examiner

*Primary Examiner*—N. Le
*Assistant Examiner*—Michael Nghiem
(74) *Attorney, Agent, or Firm*—Piper Marbury Rudnick & Wolf; William T. Rifkin; R. Blake Johnston

(57) ABSTRACT

A system for supplying ink to a composite printing head has a first compartment in fluid flow communication with a first set of orifices, and a second compartment in fluid flow communication with a second set of orifices. The first and second compartments are configured to allow the egress of ink to maintain the level of ink therein at a desired fill height. A reservoir is also provided for supplying ink to the first and second compartments.

19 Claims, 4 Drawing Sheets

INK JET PRINT HEAD MODULES WITH COMMON INK SUPPLY

BACKGROUND OF THE INVENTION

This invention relates generally to ink jet printers. More specifically, the invention relates to a system for providing liquid ink at proper static pressure to a series of drop-on-demand ink jet print orifices.

As is known, ink jet printing systems utilize printing heads in which ink droplets are emitted through one or more orifices and onto a target surface. In impulse type drop-on-demand printing, the emission of ink through the orifice is controlled by creating pressure pulses within an ink chamber in the printhead. Referring to prior art FIG. 1, a typical printhead 2 is provided with an array of orifices 3, which are individually controlled to emit ink droplets 4 that form the desired image on the target surface as the surface moves relative to the printing head. The orifices are fed ink from individual chambers S within each printhead, which communicate with corresponding input ports 6. Ink is supplied via capillary action to each input port 6 from a reservoir 7 through ink supply lines 9.

It is important that the proper static pressure, typically a small negative static pressure, is achieved at each ink jet orifice to avoid orifice drool. Static pressure within the printhead is largely a function of the static fluid pressure at the printhead input port, since capillary forces within a given printhead offset any appreciable variation in pressure head among the orifices in that printhead. Thus, the static pressure at the input port influences the pressure at the ink jet orifices which are in immediate proximity to the input port. The optimal static pressure is determined by the physical properties of the ink, such as viscosity and surface tension, wetability and the substrate material used to construct the orifices. Ordinarily, the optimal static pressure of the ink is negative one to three inches of water. As can be seen in FIG. 1, and as is known from hydraulic theory, the static pressure at the input port is a function of the difference in height (H) between the input port and the reservoir ink level. More particularly, the static pressure at each orifice is a function of the difference in height between each orifice and the reservoir ink level.

In commercial ink jet printing applications, it is advantageous to provide a printing apparatus having a large printing area to permit imaging of a large image on a target surface without multiple passes of the surface past the printing head. This may be accomplished by providing a number of printheads vertically stacked or "stitched" together. Vertically stacked printhead arrangements, however, present special problems associated with the control of static pressure, and their commercial advantages have heretofore been limited by increasing costs or complexity relating to ink storage and delivery. It is not feasible to supply all printheads in a stacked arrangement from a common reservoir because uniform static pressure cannot be achieved. As seen in FIG. 1, printheads disposed above the reservoir fluid level experience negative static pressure, while those disposed below the reservoir experience positive static pressure. Moreover, while it is feasible to provide each printhead with a separate, level-controlled reservoir as illustrated in FIG. 2, the cost of such an arrangement is prohibitive. Additionally, the space limitations and tight spacing between printheads make it physically impractical to install reservoirs and level-control devices in this configuration.

Prior art distribution systems are not readily adaptable to stacked printhead arrangements because of the complexity and costs associated with manufacturing and maintenance. There is thus desired an ink jet fluid distribution system which may be easily and inexpensively constructed and which provides proper and dependable control of the static pressure of ink delivered to each printhead in a stacked arrangement.

SUMMARY OF THE INVENTION

In view of the above, and in accordance with the present invention, there is provided a system for supplying ink to a composite printing head. A first compartment is in fluid flow communication with a first set of orifices associated with a first printhead, and a second compartment is in fluid flow communication with a second set of orifices associated with the same or a separate printhead. The first and second compartments are configured to allow the egress of ink to maintain the level of ink therein at a desired fill height, thereby controlling the static pressure of ink delivered to each set of orifices. A reservoir is also provided for supplying ink to the first and second compartments.

In a preferred embodiment of the invention, several printheads each has a set of orifices for printing or marking a substrate. Each printhead is supplied from one of the compartments of a multi-compartment reservoir via a separate feed line. The compartmentalized ink reservoirs utilize a weir system which maintains a predetermined optimum static pressure within each compartment. The feed pressure to each printhead is controlled by the relative height of the fluid column at each compartment with respect to the height of an inlet port which is immediately proximate to the set of orifices. The height of the fluid may be controlled by the height of the weir associated with that compartment or the fluid level in such weir.

The present invention provides significant advantages over other ink jet fluid distribution systems. Because the weir system automatically maintains a desired level of ink in the individual compartments, there is no need for individual level detectors for each compartment, thereby reducing parts and costs.

The present invention, together with further objects and advantages, will be best understood by reference to the following detailed description taken in conjunction with the accompanying drawings.

DETAILED DESCRIPTION OF THE PREFERRED EMBODIMENT

Figure 1:
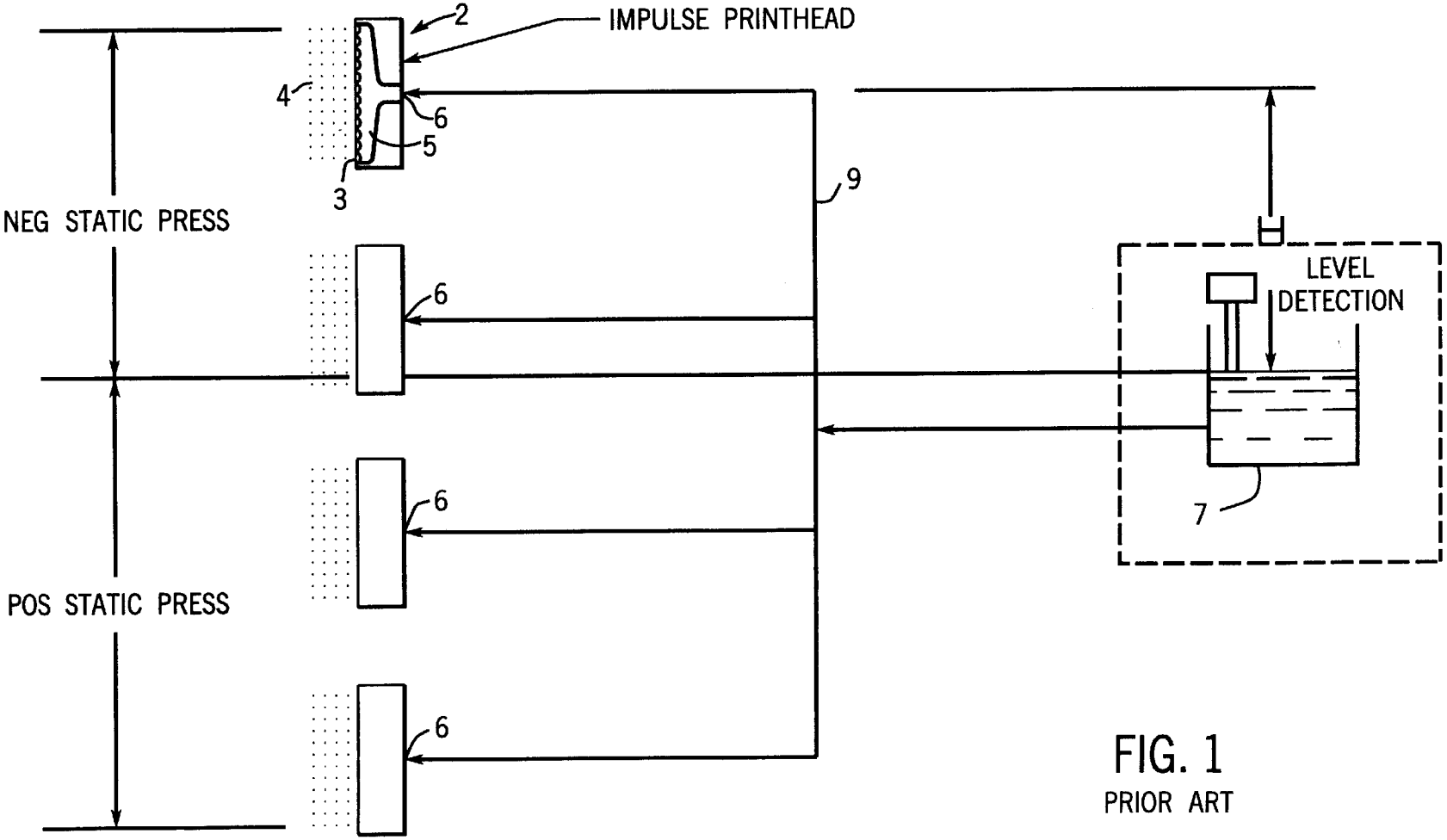
FIG. 1 PRIOR ART
FIG. 1 is an illustration of prior art printheads and ink distribution system as described above.
Figure 2:
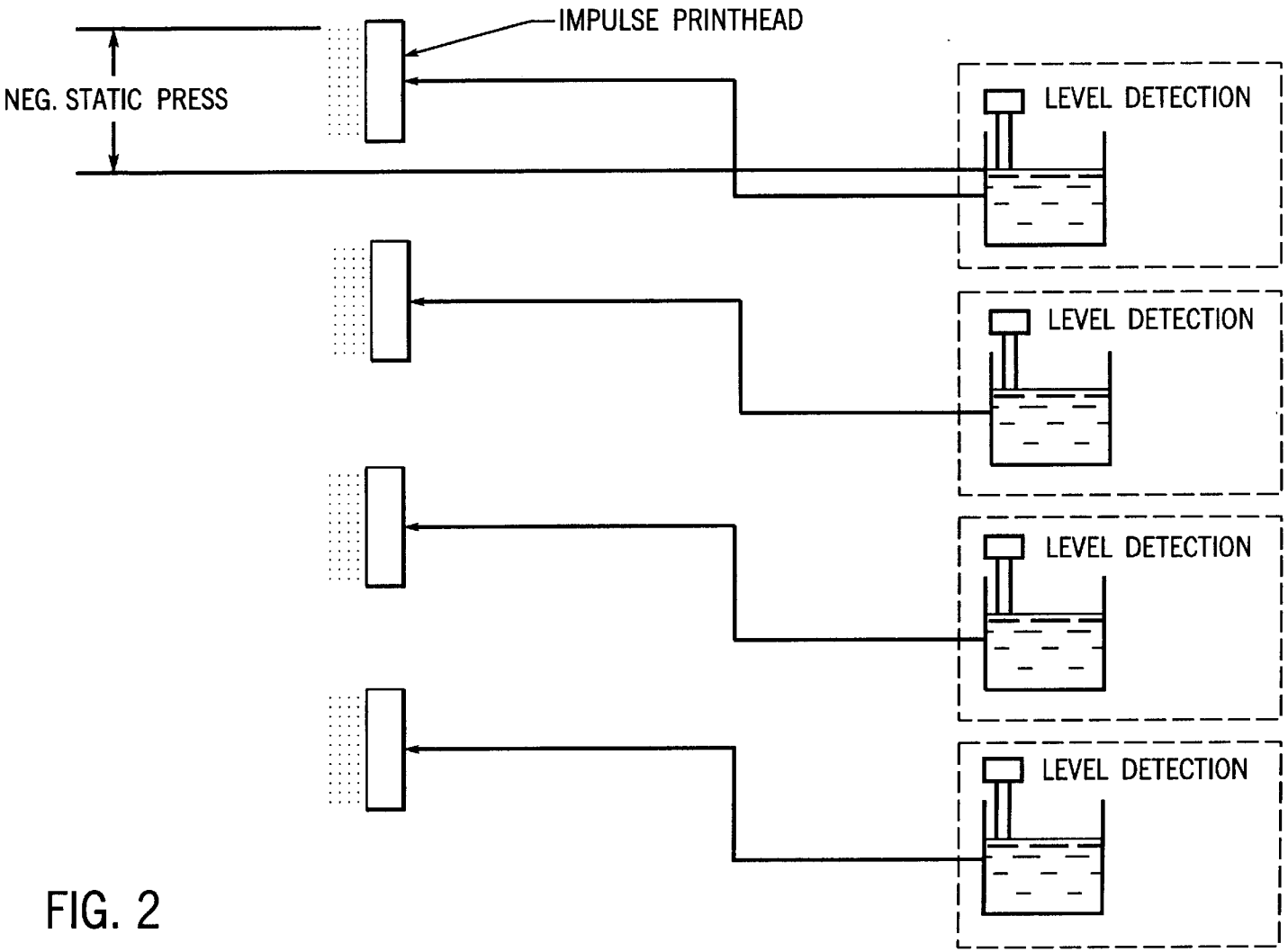
FIG. 2 illustrates the problems associated with independent level controls for a stacked printhead arrangement.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Figure 3:
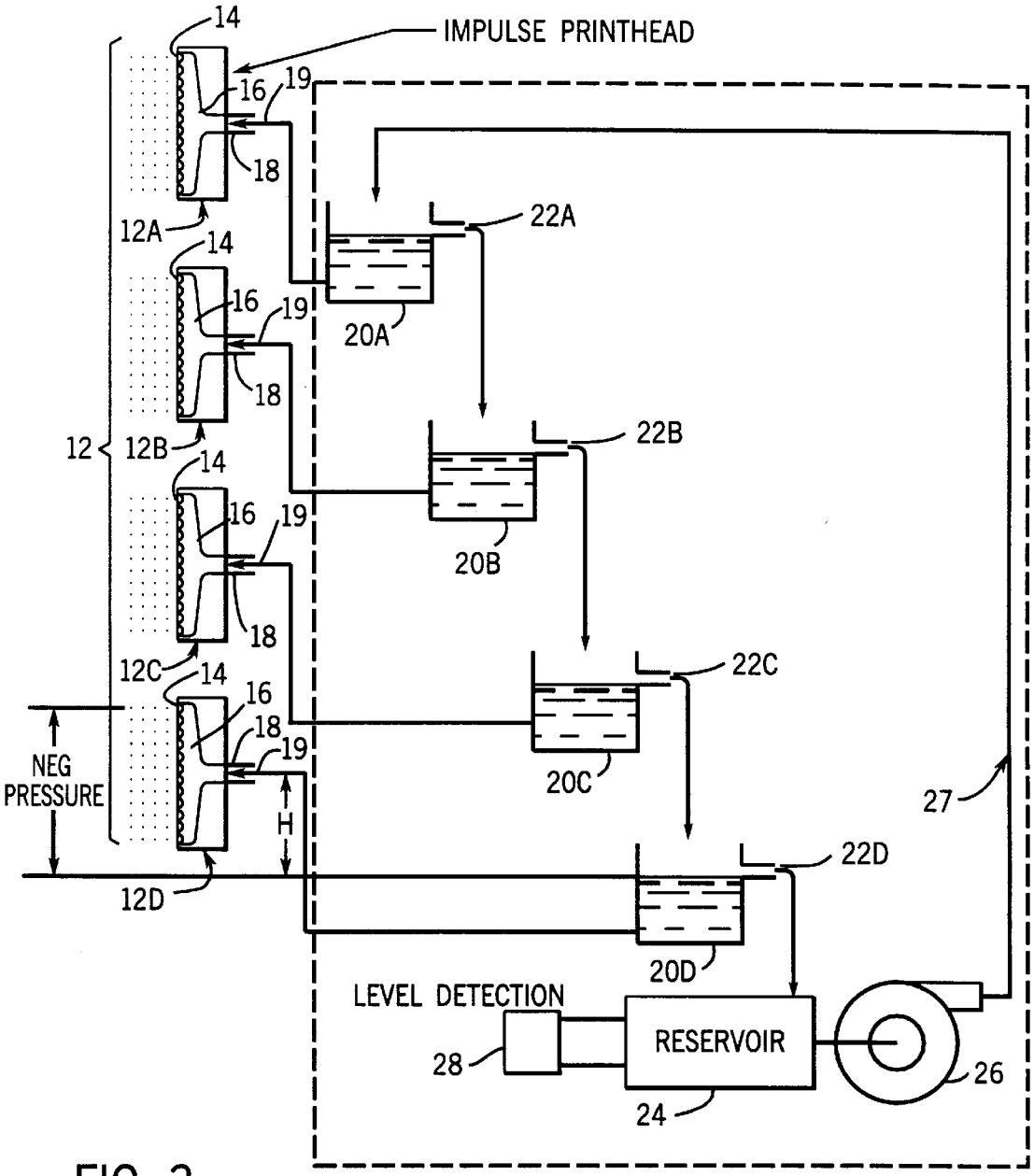
FIG. 3 is an illustration of a preferred embodiment of the invention.

Referring FIG. 3, the fluid system of the present invention comprises a composite printing head 12 including a plurality of ink jet printheads 12A–12D. Composite printing head 12 can be stationary and arranged to print an image on a target surface (not shown) which moves relative thereto. Alternatively, the printing head 12 can be movable relative to the target surface, or both the printing head 12 and the target surface can be movable relative to each other.

Although schematically illustrated as four spaced apart printheads 12A–12D, the composite printing head 12 preferably has three or four distinct internal printheads or manifolds that are integrally attached to provide an even distribution of ink as it is ejected out of the printheads. It will be appreciated that any number of printheads can be used to create the desired width of the area to be printed.

Preferably, each printhead 12A–12D has a set of ejection nozzles or orifices 14 which are supplied fluid by a common chamber or manifold 16 within each printhead 12A–D. The set of orifices may number twelve as illustrated, or more or less in number, it being within the skill of one knowledgeable in the art to choose the number of orifices and the pattern of those orifices. The manifolds 16 are supplied fluid through associated inlet ports 18 and feed lines 19 attached to the printheads 12A–D. Although it is desirable to have a separate printhead for each set of orifices, a single printhead could have two or more sets of orifices with associated inlet ports. Also, while the sets of orifices are depicted to comprise a single row, there may be multiple rows of orifices in a set, or other configurations, as those skilled in the art would understand.

To supply ink to the printheads 12A–12D through the feed lines 19, each printhead 12A–12D is provided with associated compartments 20A–20D which maintain a constant fluid level of ink therein using weirs 22A–22D. Each weir 22A–22D includes an opening, drain or other egress for permitting the flow of ink from one compartment to the next lower compartment, or in the case of the lowermost compartment 20D, back to a reservoir 24. A pump 26 provides a low-volume flow of ink from reservoir 24 to the uppermost compartment 20A via return line 27. A level detection device 28 is also provided to ensure an adequate ink reserve is fed to reservoir 24 from a main storage container (not shown). To ensure that an adequate amount of ink is supplied to the compartments, means are provided to control the flow of fluid in the return line 27. For example, a valve or other control device can be utilized, or the pump can be configured to pump ink at a desired constant flow rate through the supply line.

As will be understood, the ink level in each compartment 2A–20D may be maintained constant and therefore the static pressure at the inlet of each printhead, which is determined by the height (H) of the feed line above the ink level in its associated compartment, is the same for each printhead. The printhead 12, and preferably the entire set of orifices for each printhead 12, are disposed above the ink level in the associated compartment 20 to provide a negative pressure in feed lines 19, which combines with the capillary forces therein to yield the proper pressure at the inlet port 18 which is in immediate proximity to the orifices 14.

Figure 4:
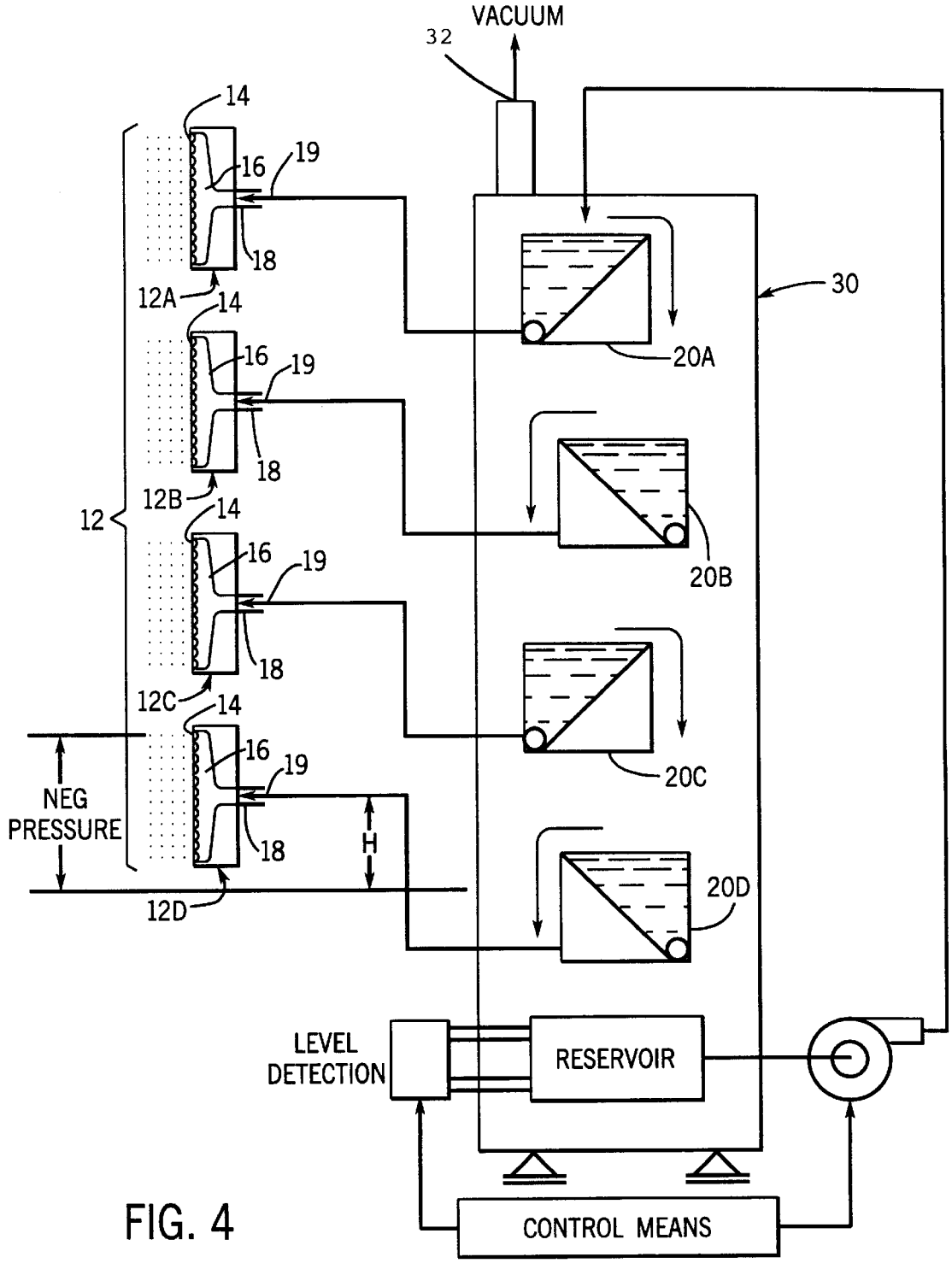
FIG. 4 is an illustration of a vacuum chamber feature of the present invention.

To lower gas vapor pressure and reduce dissolved air in the ink, a degassing device is provided, such as a membrane over the reservoir or a partial vacuum above the ink in each container. Alternatively, all of the containers 20A–20B can be placed in a single vacuum chamber 30 as shown in FIG. 4. As illustrated, the containers 20 are stacked within the chamber 30 which has a single port 32 for creating a low negative pressure to reduce dissolved air in the ink. As shown, the containers 20 can also be stacked so that the flow out of adjacent containers is in opposite directions, thereby allowing the containers to approach vertical alignment to conserve space.

Also, an adjustment mechanism can be provided to adjust the heights of the printheads 12A–12D, and therefore the sets of orifices 14, relative to the level of the ink in the compartments 20A–D. This type of adjustment mechanism is known in the art and could be configured for adjustment of the printing head 12 as a unit. The adjustment mechanism could also be configured to independently adjust the height of the printheads 12A–12B, provided they are not integrally joined together.

Similarly, a moving mechanism can be provided to adjust the heights of the compartments 20A–20D, and thus the height of the ink in each compartment, relative to the heights of the printheads 12A–12D and their associated sets of orifices 14. If the compartments 20 are joined together as a staggered unit, the moving mechanism can be configured to adjust the height of the entire assembly. Alternatively, the moving mechanism can be configured to independently adjust the height of the compartments 20. This individual adjustment can be provided by a moving mechanism such as the device disclosed in U.S. Pat. No. 5,929,882, issued Jul. 27, 1999, the disclosure of which is specifically incorporated herein by reference.

It will be appreciated that more than one return line can be used to individually feed each container rather than supplying the top container 20A. Also, various other devices can be utilized to control the drainage of ink from each container, such as valves, siphons, or the like.

While the invention is depicted in schematic form, it is within the skill of those in the art to enclose the weirs in individual cartridges or as part of a single elongated container, thereby obtaining a compact ink system for an ink jet printer. It is within the scope of the present invention to monitor the flow of ink supplied by the pump and the flow to each printhead so that each weir is maintained full to assure proper static pressure at the multiplicity of printheads.

Thus, an ink jet fluid distribution system is provided which may be easily and inexpensively constructed and which provides proper and dependable control of the static pressure of ink delivered to each printhead in a stacked arrangement.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A system for supplying ink to a composite printing head having an upper printhead at a higher elevation than a lower printhead, the upper and lower printheads each having an inlet port in fluid flow communication with a set of orifices, comprising:

an upper compartment in fluid flow communication with the upper printhead for supplying ink thereto, said upper compartment having a first outlet, said first outlet opening at a desired height relative to the upper set of orifices that is lower than the height of the upper set of orifices, ink being maintained in the first compartment at the level of said first outlet, thereby defining an upper static height difference between the upper printhead inlet port and the level of ink maintained in the upper compartment to create a back pressure acting on the ink in the inlet port;

a lower compartment in fluid flow communication with the lower printhead for supplying ink thereto, said lower compartment being positioned at a lower elevation than the upper compartment and positioned to receive an overflow of ink draining from the outlet opening of the upper compartment, said lower compartment having a second outlet, said second outlet opening at a height relative to the lower set of orifices that is lower than the lower printhead inlet port to define a lower static height difference the same as the upper static height difference, whereby back pressure acting on the ink in the upper printhead orifice is substantially the same as back pressure acting on the ink in the lower printhead orifice;

a reservoir for supplying ink to the upper compartment;

a supply line for supplying ink from the reservoir to the first compartment; and a pump for delivering the ink via said supply line from the reservoir to the first compartment.

2. A system for supplying ink to a composite inkjet printhead formed of at least two vertically disposed component printheads, comprising:

an ink compartment for each of said component printheads for communicating ink thereto, each compartment disposed at a predetermined height, relative to its corresponding printhead, to maintain a desired negative static pressure;

each of said ink compartments including a weir to maintain a desired quantity of ink therein and to permit excess ink to spill from said compartment;

said compartments being positioned, relative to each other, to cause the ink to spill from one compartment to be received in the next lower compartment;

a reservoir positioned to receive ink spillage from a lowest one of said ink compartments; and circulating means for transporting ink from said reservoir to an uppermost one of said ink compartments;

Wherein said circulating means includes a pump for pumping ink from said reservoir to an uppermost one of said ink compartments.

3. A system for supplying liquid to a composite printing head having a first set of orifices at a higher elevation than a second set of orifices, comprising:

a first compartment in fluid flow communication with the first set of orifices, said first compartment including an egress permitting liquid above a first desired level to flow from said first compartment to maintain the level of liquid therein at said desired first liquid fill level;

a second compartment in fluid flow communication with the second set of orifices, said second compartment including an egress permitting liquid above a second desired level to flow from said second compartment to maintain the level of liquid in the second compartment at said desired second liquid fill level;

said first and second compartments horizontally spaced from said first and second set of orifices, respectively;

a reservoir of liquid; and liquid circulating means for transporting liquid from said reservoir to the first and second compartments including a supply line for supplying liquid from the reservoir to the first compartment, and wherein liquid from the first compartment is directed to flow into the second compartment, and liquid from the second compartment is directed into the reservoir.

4. The system of claim 3 wherein the first desired level is at a lower elevation than a level of an inlet port to the first set of orifices, the difference in said levels defining an upper static height difference, and the second desired level is at a lower elevation than an inlet port to the second set of orifices to define a lower static height difference, said upper and lower static height differences creating a negative pressure acting on the liquid in the inlet ports.

5. The system of claim 4 wherein the upper static height difference and lower static height difference are substantially the same so that the negative pressure acting on the liquid in the inlet ports to the first and second set of orifices is approximately the same.

6. The system of claim 3 wherein the first desired level is lower than a lowermost orifice of the first set of orifices, and the second desired level height is lower than a lowermost orifice of the second set of orifices, thereby maintaining a desired negative pressure to each orifice in each set of orifices.

7. The system of claim 3 wherein the flow of liquid out of the first compartment is directed in an opposite direction to the flow of liquid out of the second compartment, thereby allowing a generally vertical stacking arrangement of the first compartment, second compartment and reservoir.

8. The system of claim 3, further comprising control means configured to ensure that an adequate amount of liquid is supplied to the compartments from the reservoir.

9. The system of claim 3 wherein said liquid circulating means comprises a pump for delivering the liquid from the reservoir to the first compartment.

10. The system of claim 3 wherein the first and second compartments are configured to hold substantially a same volume of liquid.

11. The system of claim 3 further comprising a device for creating a partial vacuum above liquid in each compartment to lower gas vapor pressures in said first and second compartments.

12. The system of claim 3 further comprising an adjustment mechanism for adjusting heights of the first and second compartments to further control the levels of liquid therein relative to said first and second sets of orifices.

13. A system for supplying ink to a composite printing head having first set of orifices at a higher elevation than a second set of orifices, comprising:

a first compartment in fluid flow communication with the first set of orifices for supplying ink thereto, said first compartment having a first outlet, said first outlet opening at a desired height relative to the height of an inlet port to the first set of orifices ink being maintained in the first compartment at the level of said first outlet, thereby defining an upper static height difference between the inlet port and the level of ink maintained in the first compartment;

a second compartment in fluid flow communication with the second set of orifices for supplying ink thereto, said second compartment having a second outlet, said second outlet opening at said desired height relative to the height of an inlet port to the second set of orifices, ink being maintained in the second compartment at the level of said second outlet, thereby defining a lower static height difference the same as the upper static height difference so that the pressure acting on the ink in the first set of orifices is substantially the same as the pressure acting on the second set of orifices;

a reservoir of liquid; and liquid circulating means for transporting liquid from said reservoir to the first compartment including a supply line for supplying ink from the reservoir to the first compartment, and wherein ink from the first compartment is directed to flow into the second compartment, and ink from the second compartment is directed into the reservoir.

14. The system of claim 13 wherein the first outlet opening is lower than a lowermost orifice of the first set of orifices, and the second outlet opening is lower than a lowermost orifice of the second set of orifices, thereby maintaining a desired negative pressure to each orifice in each set of orifices.

15. The system of claim 13 wherein the second compartment is positioned at a lower elevation than the first compartment and is positioned to receive an overflow of ink draining from the outlet opening of the first compartment.

16. The system of claim 15 wherein the overflow of liquid out of the first container is directed in an opposite direction to the overflow of liquid out of the second compartment, thereby allowing a generally vertical stacked arrangement of the first compartment, second compartment, and reservoir.

17. The system of claim 13 further comprising a control device configured to ensure that an adequate amount of liquid is supplied to the compartments from the reservoir.

18. The system of claim 13 wherein said circulating means includes a pump for delivering the ink via said supply line from the reservoir to the first compartment.

19. A system for supplying liquid to a composite printing head having an upper set of orifices at a higher elevation than a lower set of orifices, the upper set of orifices having an upper inlet port associated therewith and the lower set of orifices having a lower inlet port associated therewith, comprising for each of said upper and lower inlet ports:

a liquid compartment communicating with and positioned below said inlet port to define a static pressure differential between the inlet port and the liquid compartment;

means for supplying liquid to said liquid compartment;

means for draining liquid from the liquid compartment to maintain the liquid in said compartment at a desired level relative to the height of the inlet port.

* * * * *

UNITED STATES PATENT AND TRADEMARK OFFICE

CERTIFICATE OF CORRECTION

PATENT NO. : 6,196,668 B1
DATED : March 6, 2001
INVENTOR(S) : Bode, Henry J.

It is certified that error appears in the above-identified patent and that said Letters Patent is hereby corrected as shown below:

Title page,
Item [73], Assignee, change from: "Marconi Data Systems" to -- Marconi Data Systems, Inc. --
Item [74], *Attorney, Agent, or Firm*, change from: "Piper Marbury Rudnick & Wolf" to -- Piper Marbury Rudnick & Wolfe --

Signed and Sealed this

Twelfth Day of November, 2002

*Attest:*

*Attesting Officer*

JAMES E. ROGAN
*Director of the United States Patent and Trademark Office*